United States Patent [19]

Ketcham

[11] Patent Number: 5,024,406

[45] Date of Patent: Jun. 18, 1991

[54] DEVICE FOR HANGING OUTDOOR CHRISTMAS LIGHTS

[76] Inventor: Raymond H. Ketcham, 169 Baur St., North Babylon, N.Y. 11704

[21] Appl. No.: 473,621

[22] Filed: Jan. 31, 1990

[51] Int. Cl.[5] ..... F21V 21/00

[52] U.S. Cl. ..... 248/149; 248/185; 248/291; 362/250; 439/573

[58] Field of Search ..... 248/73, 149, 154, 185, 248/220.2, 221.3, 224.3, 291; 439/573, 754, 562, 575; 24/673, 674; 403/93, 97; 313/49, 51; 362/152, 250, 429, 806, 145

[56] References Cited

U.S. PATENT DOCUMENTS

| | | | |
|---|---|---|---|
| 1,070,113 | 8/1913 | Carr | 24/674 |
| 2,299,733 | 10/1942 | Benander | 439/575 |
| 2,889,451 | 6/1959 | Longo | 439/573 |
| 3,291,428 | 12/1966 | Sisulak | 248/300 |
| 3,341,699 | 9/1967 | Somermayer | 362/145 |
| 3,678,443 | 7/1972 | Koehler | 439/575 |
| 3,883,926 | 5/1975 | Reynolds | 248/238 |
| 4,714,219 | 12/1987 | Mayse | 248/65 |
| 4,769,749 | 9/1988 | Felski | 362/806 |
| 4,777,573 | 10/1988 | Liao | 313/51 |
| 4,836,482 | 6/1989 | Sokol | 248/291 |
| 4,929,112 | 5/1990 | Wilcox | 403/93 |

*Primary Examiner*—Ramon O. Ramirez
*Assistant Examiner*—Robert A. Olson
*Attorney, Agent, or Firm*—Richard L. Miller

[57] ABSTRACT

A hanging outdoor christmas light holder for a lamp socket fixture is provided and consists of a removably attaching member having a first component that is permanently attachable to a static structure on a building, while a second mating component is carried on underside of the lamp socket fixture so that the lamp socket fixture can be quickly and simply attached thereto and removed therefrom.

3 Claims, 2 Drawing Sheets

FIG.5
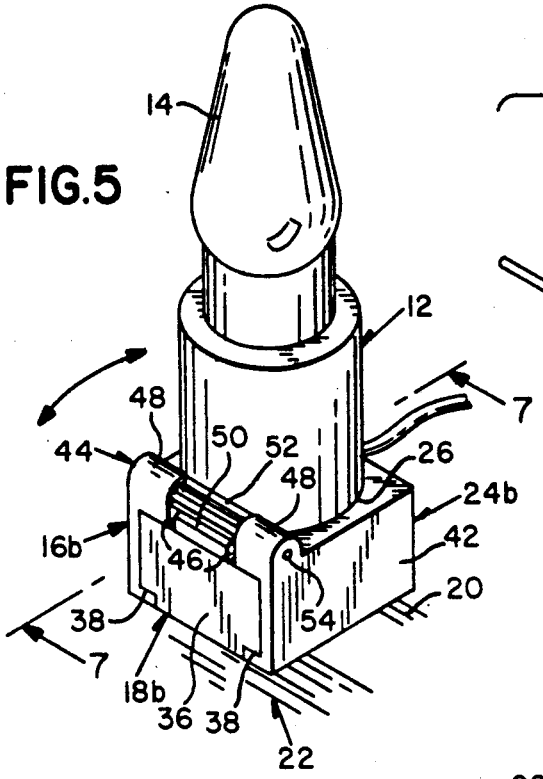
FIG.6
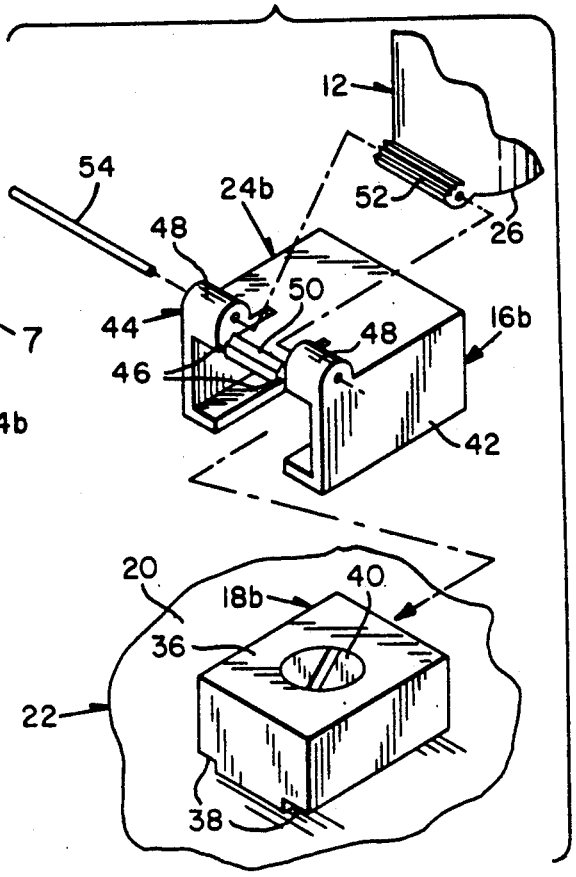
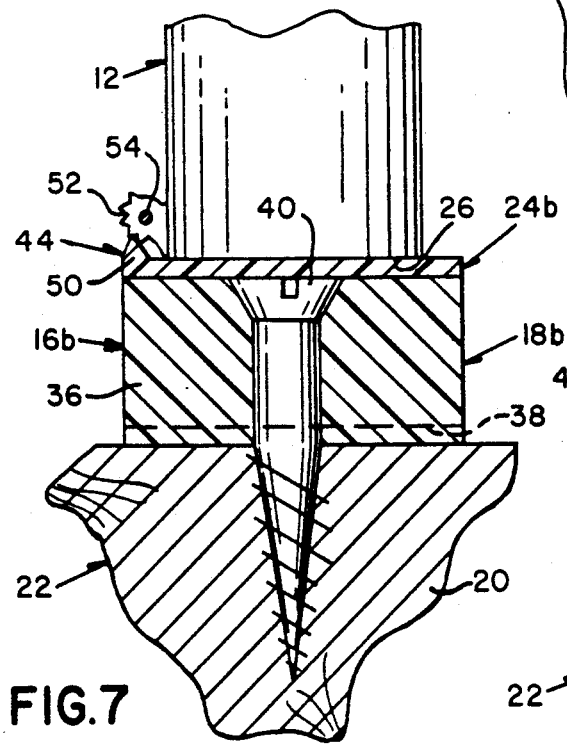
FIG.7
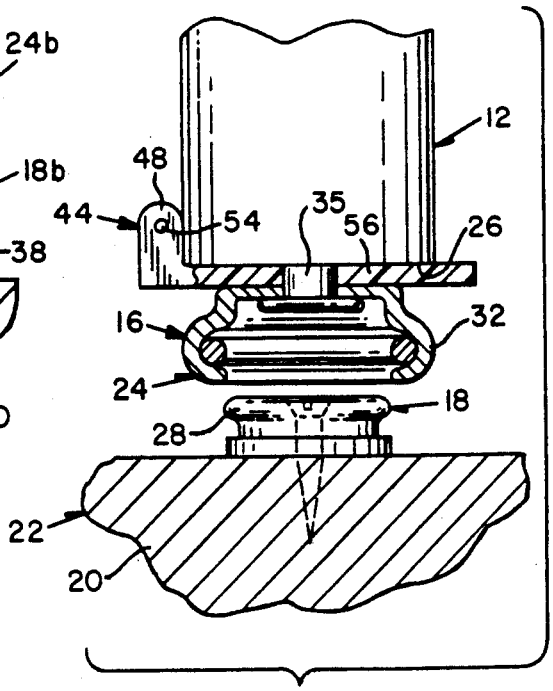
FIG. 8

DEVICE FOR HANGING OUTDOOR CHRISTMAS LIGHTS

BACKGROUND OF THE INVENTION

The instant invention relates generally to electric lamp mounting structures and more specifically it relates to a hanging outdoor christmas light holder.

Numerous electric lamp mounting structures have been provided in the prior art that are adapted to clamp strings of decorative lights to buildings and other structures. For example, U.S. Pat. Nos. 3,291,428 to Sisulak; 3,883,926 to Reynolds and 4,714,219 to Mayse all are illustrative of such prior art. While these units may be suitable for the particular purpose to which they address, they would not be as suitable for the purpose of the present invention as hereafter described.

SUMMARY OF THE INVENTION

A primary object of the present invention is to provide a hanging outdoor christmas light holder that will overcome the shortcomings of the prior art devices.

Another object is to provide a hanging outdoor christmas light holder in which the christmas lights can be quickly and simple reattached and removed to and from a building without using special tools or skill, once an initial installation has been completed.

An additional object is to provide a hanging outdoor christmas light holder that is manufactured out of durable and reliable material so that a fastener component of the holder can be permanently mounted to a static structure of a building on a continual all year basis.

A further object is to provide a hanging outdoor christmas light holder that is simple and easy to use.

A still further object is to provide a hanging outdoor christmas light holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that may be made in the specific construction illustrated and described within the scope of the appended claims.

BRIEF DESCRIPTION OF THE DRAWING FIGURES

The figures in the drawings are briefly described as follows

FIG. 5 is a perspective view of a third embodiment of the instant invention;

FIG. 6 is an exploded perspective view thereof with parts broken away.

FIG. 7 is an enlarged partial cross sectional view taken along line 7—7 of FIG. 5; and FIG. 8 is an enlarged partial cross sectional view taken along line 7—7 of FIG. 5 of a fourth embodiment of the instant invention.

DETAILED DESCRIPTION OF THE PREFERRED EMBODIMENTS

Figure 1:
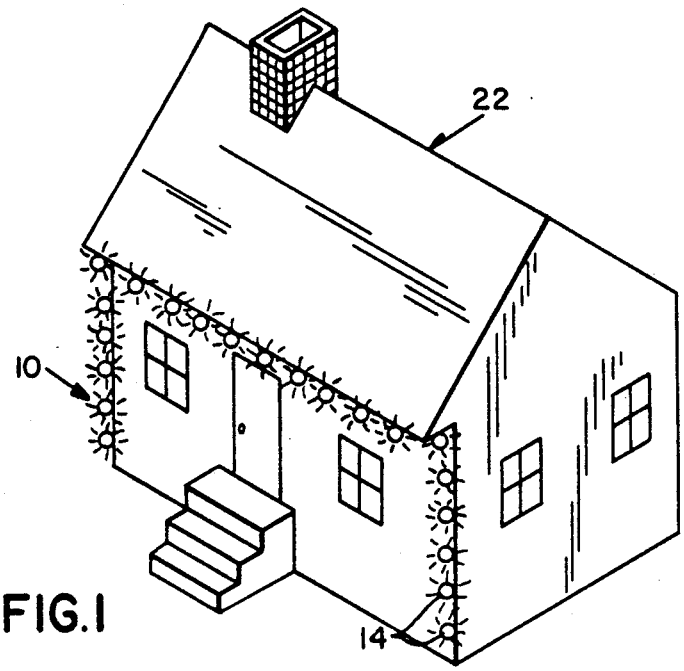
FIG. 1 is a perspective view of a house with the instant invention installed thereon.
Figure 2:
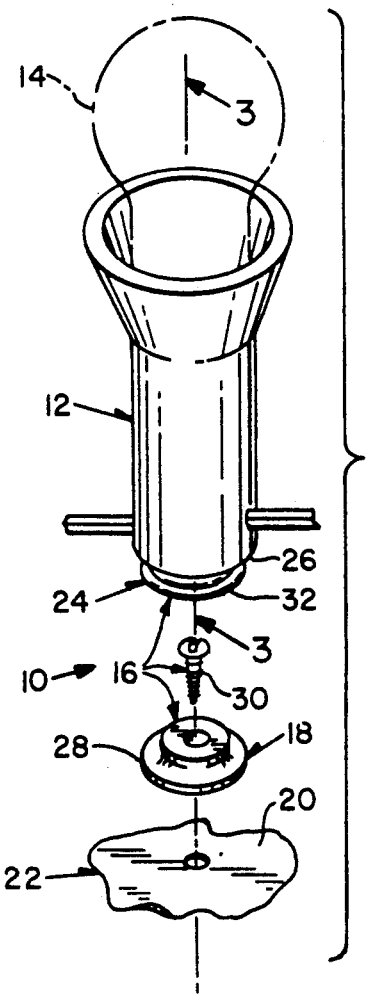
FIG. 2 is an exploded perspective view of a first embodiment of the invention.
Figure 3:
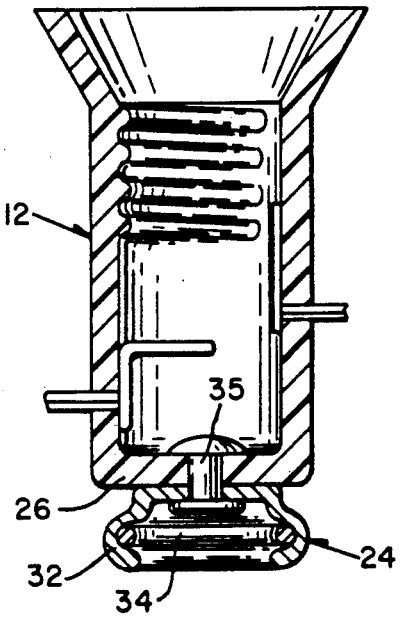
FIG. 3 is a cross sectional view taken on line 3—3 in FIG. 2.

Turning now descriptively to the drawings, in which similar reference characters denote similar elements throughout the several views, FIGS. 1 through 3 illustrate a hanging outdoor christmas light holder 10 for a lamp socket fixture 12 with lamp 14. The holder 10 consists of a removably attached to a static structure 20 on a building 22. A second mating component 24 is carried on underside 26 of the lamp socket fixture 12 so that the lamp socket fixture can be quickly and simply attached thereto.

The first component 18 of the removably attaching member 16 is a male snap member 28 and is permanently attached to the static structure 20 on the building 22 by a screw fastener 30. The second component 24 of the removably attaching member 16 is a female snap member 32 is attached to the underside 26 of the lamp socket fixture 12 by a rivet 35 to removably engage with the male snap member 28. It is to be noted that it is well within the scope of this invention to interchange the rolls of the male and female snap members 28 and 32 without departing from the spirit of the invention.

Figure 4:
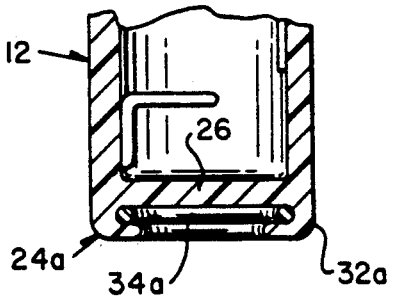
FIG. 4 is a partial cross sectional view with part broken away, similar to FIG. 3 of a second embodiment of the invention.

FIG. 4 shows a modified second component **24*a* of the removably attaching member 16*a* as a built-in female snap member 32*a* with an internal retainer ring 34*a*. The female snap member 32*a* is formed onto underside 26 of the lamp socket fixture 12 to removably engage with the male snap member 28**.

FIGS. 5, 6 and 7 show another removably attaching member **16*b* that includes the first component 18*b* being a mounting block member 36 having an undercut 38 on opposite sides thereof. A screw fastener 40 is for permanently attaching the mounting block 36 to the static structure 20 on the building 22. The second component 24*b* is a C-shaped clam member 42 affixed to the underside 26 of the lamp socket fixture 12 to removably engage with the mounting block member 36**.

A structure 44 is provided for adjustably affixing one top edge of the second component **24*b* of the removably attaching member 16*b* to one side of the underside 26 of the lamp socket fixture 12 so that the lamp socket fixture can be angularly positioned with respect to the removably attaching member 16*b***.

The adjustably affixing structure 44 includes the second component **24*b* of the removably attaching member 16*b* has a pair of spaced apart slots 46 extending inwardly from the top edge thereof. A pair of bosses 48 are each formed on the top edge of the second component 24*b* of the removably attaching member 16*b* between one of the slots 46 and corner thereof. An upwardly extending tooth 50 is formed on the top edge of the second component 24*b* of the removably attaching member 16*b* between the slots 46 so that the tooth 50 will be flexible. A fixed gear-shaped part 52 is affixed to the one side of the underside 26 of the lamp socket fixture 12 so as to fit between the bosses 48 to engage with the tooth 50. A shaft 54 extends through the bosses 48 and the fixed gear-shaped part 52 so that the fixed gear-shaped part on lamp socket fixture 12 can pivot thereabout allowing the tooth 50 to adjustably engage with the fixed gear-shaped part 52 for holding the lamp socket fixture 12** in any angular position.

FIG. 8 shows still another modification in which the adjustably affixing structure 44 has an extended plate 56 so that the second component 24 of the removably attaching member 16 which is the female snap member 32 can be attached to the plate 56 by the rivet 35 instead of directly to the underside 26 of the lamp socket fixture 12. This will also enable the lamp socket fixture to be positioned in any angular position as is done in FIGS. 5, 6 and 7.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hanging outdoor christmas light holder comprising:

a) a lamp socket fixture;

b) a removably attaching member having a first component that is permanently attachable to a static structure on a building;

c) a second mating component that is carried on underside of the lamp socket fixture so that the lamp socket fixture can be quickly and simply removably attached thereto; and d) means for adjustably affixing one top edge of said second component of said removably attaching member to one side of the underside of the lamp socket fixture so that the lamp socket fixture can be angularly positioned with respect to said removably attaching member, wherein said adjustably affixing means includes:

i) said second component of said removably attaching member having a pair of spaced apart slots extending inwardly from the top edge thereof;

ii) a pair of bosses each formed on the top edge of said second component of said removably attaching member between one of said slots and corner thereof;

iii) an upwardly extending tooth formed on the top edge of said second component of said removably attaching member between said slots so that said tooth will be flexible;

iv) a fixed gear-shaped part affixed to the one side of the underside of the lamp socket fixture so as to fit between said bosses to engage with said tooth; and v) a shaft to extend through said bosses and said fixed gear-shaped part so that said fixed gear-shaped part on the lamp socket fixture can pivot thereabout allowing said tooth to adjustably engage with said fixed gear-shaped part for holding the lamp socket fixture in any angular position.

2. A hanging outdoor christmas light holder as recited in claim 1, wherein said first component of said removably attaching member is a male snap member and is permanently attachable to the static structure on the building by a screw fastener, wherein said second component of said removably attaching member is a female snap member with an internal retainer ring in which said female snap member is affixed to the underside of the lamp socket fixture to removably engage with said male snap member attachable to said static structure.

3. A hanging outdoor christmas light holder as recited in claim 1, wherein said first component of said removably attaching member is a male snap member and is permanently attachable to the static structure on the building by a screw fastener, wherein said second component of said removably attaching member is a built-in female snap member with an internal retainer ring in which said built-in female snap member is formed onto underside of the lamp socket fixture to removably engage with said male snap member.

* * * * *